United States Patent [19]

Dyer

[11] Patent Number: 4,743,267

[45] Date of Patent: May 10, 1988

[54] PROCESS FOR IMPROVING POLYMER FIBER PROPERTIES AND FIBERS PRODUCED THEREBY

[75] Inventor: Michael E. Dyer, Cleveland, Tenn.

[73] Assignee: International Yarn Corporation of Tennessee, Cleveland, Tenn.

[21] Appl. No.: 426,498

[22] Filed: Sep. 29, 1982

Related U.S. Application Data

[63] Continuation-in-part of Ser. No. 390,732, Jun. 21, 1982, abandoned, which is a continuation-in-part of Ser. No. 296,656, Aug. 27, 1981, abandoned, which is a continuation-in-part of Ser. No. 273,713, Jun. 15, 1981, abandoned, which is a continuation-in-part of Ser. No. 223,056, Jan. 7, 1981, abandoned.

[51] Int. Cl.[4] ..... D06M 13/34

[52] U.S. Cl. ..... 8/194; 8/181; 8/129; 8/115.58

[58] Field of Search ..... 8/115.5, 128 R, 128 A, 8/116 R, 194, 129, 115.58; 525/426

[56] References Cited

U.S. PATENT DOCUMENTS

| | | | |
|---|---|---|---|
| 2,732,317 | 1/1956 | Kirby | 527/312 |
| 2,764,504 | 9/1956 | Jacobson et al. | 524/733 |
| 2,784,052 | 3/1957 | Jacobson | 8/130 |
| 2,956,899 | 10/1960 | Cline | 522/144 |
| 2,959,565 | 11/1960 | Stanton et al. | 525/426 |
| 3,005,730 | 10/1961 | Pardo, Jr. et al. | 428/396 |
| 3,046,078 | 7/1962 | Salsbury et al. | 8/149.2 |
| 3,083,118 | 3/1963 | Bridgeford | 428/375 |
| 3,092,512 | 6/1963 | Magat et al. | 522/138 |
| 3,097,185 | 7/1963 | Armen et al. | 525/73 |
| 3,099,631 | 7/1963 | Tanner | 521/134 |
| 3,115,418 | 12/1963 | Magat et al. | 428/420 |
| 3,202,541 | 8/1965 | Hochberg | 427/392 |
| 3,216,781 | 11/1965 | Pardo et al. | 8/127.6 |
| 3,218,117 | 11/1965 | Chen et al. | 8/539 |
| 3,236,584 | 2/1966 | Degering | 8/116.1 |
| 3,252,880 | 5/1966 | Magat et al. | 522/68 |
| 3,278,639 | 10/1966 | Matray | 525/426 |
| 3,291,560 | 12/1966 | Machell et al. | 8/116.1 |
| 3,297,471 | 1/1967 | Trauman | 427/341 |
| 3,313,591 | 4/1967 | Tanner | 8/115.62 |
| 3,514,385 | 5/1970 | Magat et al. | 522/89 |
| 3,598,514 | 8/1971 | Sello et al. | 8/115.6 |
| 3,687,878 | 8/1972 | Imoto et al. | 527/313 |
| 3,909,195 | 9/1975 | Machell et al. | 8/115.7 |
| 3,995,998 | 12/1976 | Rowland et al. | 8/115.6 |
| 4,043,753 | 8/1977 | Barbee | 8/115.62 |
| 4,063,887 | 12/1977 | Forschirm | 8/130.1 |
| 4,135,877 | 1/1979 | Aikawa et al. | 8/115.59 |
| 4,227,882 | 10/1980 | Saito et al. | 8/115.59 |
| 4,238,193 | 12/1980 | Kisaichi et al. | 8/115.59 |
| 4,438,151 | 3/1984 | Yamaguchi et al. | 427/36 |

FOREIGN PATENT DOCUMENTS

| | | |
|---|---|---|
| 628385 | 6/1957 | Canada . |
| 71299 | 1/1974 | Japan . |
| 49-61500 | 6/1974 | Japan . |
| 30197 | 11/1975 | Japan . |
| 54-11395 | 1/1979 | Japan . |
| 54-134112 | 10/1979 | Japan . |
| 55-36334 | 3/1980 | Japan . |
| 55-40815 | 3/1980 | Japan . |
| 55-670171 | 5/1980 | Japan . |
| 770766 | 12/1954 | United Kingdom . |
| 805513 | 11/1956 | United Kingdom . |
| 845690 | 6/1958 | United Kingdom . |
| 872132 | 4/1960 | United Kingdom . |
| 901038 | 7/1962 | United Kingdom . |
| 1067494 | 12/1963 | United Kingdom . |
| 1017861 | 1/1966 | United Kingdom . |
| 1225275 | 3/1967 | United Kingdom . |
| 1128696 | 5/1967 | United Kingdom . |
| 1189501 | 6/1967 | United Kingdom . |
| 1279709 | 8/1968 | United Kingdom . |
| 1311542 | 6/1969 | United Kingdom . |

OTHER PUBLICATIONS

F. W. Jones and J. D. Leeder; "Wool-Polymer Systems: The Effect of the Internal Deposition of Polymers, etc."; Jones and Leeder; Sep. 9, 1974, pp. 627-631.

G. Sumrell, M. F. Margaviom and C. M. Welch; "The Acrylation, Methacrylation, and Acrylamidomethylation of Cellulose"-Application of Two Novel Cross--Linking Reactions to Cotton; Textile Research Journal; Jun. 3, 1968, pp. 78-85.

D. M. Jones, R. N. Robinson, and N. F. Wood; "The Cross-Linking of Cotton with Divinyl Ethers"; JSDC Mar. 1965; Jones, Robinson, and Wood; pp. 108-114.

Chem. Abstract vol. 82, 74381 (1975).

*Primary Examiner*—Paul Lieberman
*Assistant Examiner*—John F. McNally
*Attorney, Agent, or Firm*—Oblon, Fisher, Spivak, McClelland & Maier

[57] ABSTRACT

A method is provided for treating polyester, and acrylic polymer fibers or fibrous structures made thereof to permanently improve the antistatic, hygroscopic, dye receptive, soil release, inter-fiber adhesion and bonding properties of the fibers and structures. The method involves contacting the fibers with an aqueous solution containing at least one unsaturated monomer and having an acid pH and a temperature between about 60° C. and about 100° C. After allowing the solution to uniformly disperse among the fibers, so that the monomer intimately contacts the fiber surfaces, polymerization of the monomer on the fiber surfaces is initiated by a polymerization initiator for the monomer, and the polymerization is continued for a sufficient time to allow substantial graft polymerization of the monomer on the fibers to modify the surface properties of the fibers. The fibers are preferably scoured prior to the treatment process, and after polymerization the fibers are rinsed to remove acid and excess homopolymer prior to dyeing and/or further processing of the fibers. The fibers may be in the form of knitted, woven or nonwoven fabrics, and may include mixtures of fibers such as acrylic yarns and nylon filaments or polyester and cotton staple fiber blends.

23 Claims, No Drawings

PROCESS FOR IMPROVING POLYMER FIBER PROPERTIES AND FIBERS PRODUCED THEREBY

CROSS-REFERENCES TO RELATED APPLICATIONS

This application is a continuation-in-part of U.S. application Ser. No. 390,732, filed June 21, 1982, now abandoned, which is in turn a continuation-in-part of U.S. application Ser. No. 296,656, filed Aug. 27, 1981, now abandoned, which is in turn a continuation-in-part of U.S. application Ser. No. 273,713, filed June 15, 1981, now abandoned, which in turn is a continuation-in-part of U.S. application Ser. No. 223,056, filed Jan. 7, 1981, now abandoned. This disclosures of each of these patent applications is incorporated herein by reference.

This application is also related to U.S. application Ser. No. 364,045, filed Mar. 31, 1982, now abandoned, which is a continuation-in-part of U.S. application Ser. No. 128,062, filed Mar. 7, 1980.

FIELD OF THE INVENTION

The present invention relates to the treatment of polymer fibers to permanently and substantially improve their hygroscopic, antistatic, dye receptive and soil release properties, as well as altering the hand of such fibers. More particularly, the invention relates to the treatment of polyester and acrylic fibers to improve thier surface properties.

BACKGROUND OF THE INVENTION

With the advent of technology to produce synthetic fibers that serve mankind not only by being more economical and stronger than natural fibers, but also by freeing up much needed agricultural land that heretofore had been needed to grow vast quantities of natural fibers, came a quest for a process that would impart to these synthetic fibers the same beneficial qualities possessed by natural fibers. The major quality that synthetic fibers lack, the one attribute that would make them cool and comfortable like the natural fibers, is the ability to substantially absorb moisture.

Throughout this application the terms "absorb" and "absorption" will be used to refer generally to the hygroscopic properties of the fibers and fabrics made therefrom. However, it will be understood that these terms refer to related hygroscopic properties such as adsorption, moisture transport, wicking, wettability, etc. Thus, although the term "adsorption" may be more appropriate for referring to the attraction of water to the outer surfaces of fibers per se, and the term "absorption" may be more appropriate for referring to the dispersal of moisture in the interstices between the fibers of a fabric, the term "absorption" will be used for convenience to refer to both phenomena.

The present invention satisfies this much sought after quest and provides to synthetic fibers qualities once attributable only to natural fibers such as significant water absorbency, superior dye receptivity and antistatic qualities. At the same time, the present invention allows for the production of synthetic fibers that have superior soil release qualities.

It has been known in the prior art to attempt to graft-polymerize water-soluble monomers such as acrylic acid, acrylamide and N,N'-methylene-bis-acrylamide (NBA) onto fibers to impart antistatic and water absorption properties to the fibers. However, such attempts at graft polymerization have been problematic due to the inability to obtain substantial or even any graft polymerization, difficulties in controlling the process conditions and the tendency to form large amounts of homopolymers. Excess homopolymers adhere to the inner walls of the processing equipment thus causing both a time and labor-consuming clean-up job. Also, disposal of the residue solution containing a large amount of homopolymers is a source of industrial pollution. Fabrics thus treated in an environment of excessive homopolymers have their surfaces coated with a thick homopolymer layer which imparts moisture-absorption and antistatic properties to the fibers. Unfortunately, these properties are not permanent and are lost within about ten washings. Furthermore, excessive homopolymers tend to cause blotching on treated fabrics which interferes with acceptable commercial dyeing and results in inferior treated fabrics.

In an alternative polymerization process that comprises impregnating fibers with a solution containing a monomer and a polymerization initiator, such as peroxide or persulfate, and heating them, it takes a long period of time to start and advance the polymerization reaction; moreover, the polymers that adhere to fibers are removed quite easily by washing so that their antistatic and moisture-absorption properties can no longer be retained.

Still another process involves applying a water-soluble vinyl monomer together with a polymerization initiator to fibrous structures and heating them in a non-solvent of the monomer, such as hydrocarbons or the like. Such process has problems of industrial hygiene and workability including solvent recovery.

U.S. Pat. No. 3,313,591 describes a process of graft polymerizing ethylenically unsaturated monomers to polycarbonamides to improve various properties of the polymer structure. According to that process, polymerization initiators are eliminated and heat is used as the sole graft initiator for producing the free radicals necessary for graft polymerization.

A more recent attempt to cure the deficiency in the prior art is disclosed in U.S. Pat. No. 4,135,877 to Aikawa et al. This patent discloses a process of graft polymerizing certain selected vinyl monomers to polyamides or fiber structures. According to the process described in that patent, polymerization initiators are eliminated and heat is used as in the Tanner method of U.S. Pat. No. 3,313,591, but the aqueous treating solution also contains an acid.

Other patents disclosing the graft polymerization of monomers to polyamides and other polymer structures include U.S. Pat. Nos. 3,097,185; 3,099,631; 3,252,880 and 3,278,639. However, the methods of these patents involve the use of ionizing radiation in the formation of a polymer melt in order to effect graft polymerization.

While many of these processes of the prior art result in improved antistatic, hygroscopic and dye receptive properties in the polymer, they have not been entirely successful commercially due to the difficulties in obtaining permanent and substantial results and other processing difficulties due to excessive formation of homopolymers which are difficult to remove from the final product and process equipment. Furthermore, some prior art methods require high concentrations of monomer, rather than low concentrations of monomer; and other prior art methods require long periods of time.

The possibility of improving such properties of synthetic fabrics in general, including but not limited to polyamides, polyesters and acrylics, is important since many of these fabrics exhibit characteristically undesirable properties such as static cling, poor water absorbency and poor dye receptivity. Hence, the commercial acceptance of many synthetic fabrics has been severely limited. Heretofore, I am aware of no commercially successful process which has resulted in a treated fiber having substantially improved antistatic, hygroscopic and dye receptive properties which are permanent and can withstand repeated washings.

My application Ser. No. 390,732, now abandoned, discloses a method of treating polymer fibers containing active hydrogen atoms, particularly nylon, which are not naturally absorbent and are subject to static electricity problems. The method of that invention is also beneficial to enhance the properties of absorbent fibers such as cotton. Treating a blend consisting of cotton and synthetic fibers in accordance with that method may allow the use of less cotton in the blend to achieve a comparable fabric. However, that method was not previously thought to be applicable to polyester or acrylic fibers.

SUMMARY OF THE INVENTION

According to the present invention, polymer fibers or fibrous structures made thereof (hereinafter simply referred to as "polymer fibers") comprising polyester or acrylic polymers are treated with a heated acidic solution of at least one unsaturated monomer, followed by polymerization of the monomer with a polymerization initiator in order to modify the surface characteristics of the polymer fibers. The treatment process comprises essentially three steps: (1) contacting the fibers with an aqueous solution having a pH below 7 and a temperature between about 60° C. and about 100° C. and containing at least one unsaturated monomer. The solution is preferably agitated or forced to flow among the fibers for a sufficient time to allow uniform dispersal and intimate contact of the monomer with the fiber surfaces; (2) thereafter initiating polymerization of the monomer on the fiber surfaces using a polymerization initiator, such as a persulfate or peroxide compound; and (3) continuing the polymerization for a sufficient time to allow substantial graft polymerization of the monomer on the fiber surfaces to modify the surface characteristics of the polymer fibers.

The fibers are preferably immersed in the treating solution, usually in the form of a knitted, woven or nonwoven fabric, and many variations are possible in the order of addition of the various components to the treating solution. A preferred monomer for use in the invention is N,N'-methylene-bis-acrylamide. The pH of the solution may be adjusted by addition of an acid or by use of an acid monomer. The treatment is preferably carried out at low concentrations of monomer and polymerization initiator and for short periods of time so as to avoid as much as possible substantial homopolymerization of the monomer.

The fibers are preferably scoured prior to the treatment process to clean the fibers and remove surface chemicals which may interfere with the graft polymerization of the monomer on the fiber surfaces. Dyeing of the fibers is preferably carried out after the treatment process and after rinsing the fibers to remove acid and excess homopolymers which would otherwise interfere with the dyeing.

The fibers resulting from the process of the present invention have substantially improved water absorbency, dye receptivity, antistatic, soil release and interfiber adhesion and bonding properties and fabric hand. The fibers so treated by the present invention will retain their enhanced properties even when subject to many vigorous washings.

DETAILED DESCRIPTION OF THE INVENTION

Polymer fibers to which the present invention is directed include conventional polyester, and acrylic polymers, and combinations of these polymer fibers with other synthetic and/or natural fibers. Nonlimiting examples of natural fibers which may be combined with the polyester, and acrylic polymer fibers include wool, cotton and silk. Non-limiting examples of synthetic polymer fibers which may be combined with the polyester, and/or acrylic fibers include nylon, acetate and cellulosic fibers, e.g., rayon.

The subject invention concerns the treating of polymer fibers per se and fibrous structures made thereof. The term "fibrous structures" includes continuous filaments, multifilament threads, batts, staple fibers, woven or knitted fabrics and non-woven fabrics, and the like composed of at least one kind of the fibers mentioned above. As used herein, the term "polymer fibers" will be understood to include fibrous structures such as the above and others. Wherever the present disclosure refers to fiber surfaces or intimate contact of the monomer with fiber surfaces or like expressions, it will be understood that the individual fibers or filaments are being referred to, such that contact and attachment of the monomer and graft polymer is with the surfaces of individual filaments of a multifilament thread or bundle, for example.

Polyester is the generic name for a fiber manufactured either as a staple fiber or continuous filament in which the fiber-forming substance is any long chain synthetic polymer composed of at least 85% by weight of an ester of a dihydric alcohol and terephthalic acid. The most common polyester fibers available in the United States are made of polyethylene terephthalate, and are available for example under the trademarks "DACRON" of E. I. duPont de Nemours & Co. and "FORTREL" of ICI United States, Inc. and Celanese Chemical Co. Polyester fibers are available as filament yarn, staple fibers and fiber tows and are often combined with other fibers such as cotton and wool. For example, much clothing is made from yarns which are a blend of polyester and cotton staple fibers. Fabrics made from such polyester fibers and fiber combinations are commonly used for making many types of outerwear, including dresses, suits, shirts, etc.

Polyesters form excellent fabrics and can be produced very cheaply on a mass production basis, but polyesters suffer from many drawbacks. Polyesters lack the ability to significantly absorb water and are subject to static electricity problems. By treating polyester fibers according to the process of the present invention, a most useful fabric is formed which has very good water absorbing, dye receptive and antistatic properties which are retained after many washings.

Acrylic is the generic name for fibers in which the fiber-forming substance is any long chain synthetic polymer composed of at least 85% by weight of acrylonitrile units ($—CH_2CH(CN)—$). Such fibers are available in various types of staple fibers and tow, and are commercially available under the trademarks "ORLON" of E. I. duPont de Nemours, & Co. and "CRESLAN" of American Cyanamid Co, for example. Acrylic fibers for wearing apparel are usually blended with other fibers such as wool, or formed into yarns which are then knitted with other stronger synthetic fibers or filaments, such as nylon.

As with polyesters and other synthetic fibers, acrylics lack the ability to significantly absorb water and are subject to static. By treating acrylic fibers according to the process of the present invention, fabrics are obtained which have excellent water-absorbing, dye receptive and anti-static properties which are retained after many washings. As indicated in my application Ser. No. 390,732, now abandoned such surface characteristics are also improved in the other synthetic and natural fibers which may be combined with acrylics and/or polyesters.

The process of the present invention differs from those of the prior art in that polymerization of the monomer to be graft polymerized onto the polymer fibers is delayed until there has been intimate contact of the monomer with the surface of the polymer fiber. Thus, while applicant does not wish to be bound by any particular theory or mechanism of reaction, it is believed that the unsaturated monomer first attaches to the polymer chain on a molecule by molecule basis in the presence of acid and heat. Thereafter, when the polymerization is initiated by addition or activation of a polymerization initiator, the monomer begins to polymerize so that there is chain addition of monomer to the single monomer additions initially grafted onto the polymer fibers. If significant homopolymerization of the monomer takes place prior to attachment of the monomer to the fibers, most of it will simply be washed off the fibers so that there will be no significant permanent improvement in the surface properties of the fibers.

Accordingly, the first step of the method according to the present invention comprises the formation of an aqueous treating solution with dissolved monomer having an acidic pH (i.e. below about 7) and heated to a temperature of about 60° C. to about 100° C. and preferably in the range of about 70° C. to 90° C. While temperatures above 100° C. are possible, they make processing more difficult and may make subsequent polymerization difficult to control. Similarly, temperatures below about 60° C. may be possible but would usually result in a processing taking too long a time to be feasible commercially.

It is not necessary that the temperature be constant throughout the first step or throughout the process. For example, the treating solution could be formed at about 70° C., or such temperature as will allow ready dissolving of the monomer and/or acid in the solution, and then the temperature could be raised to the desired level for polymerization just prior to initiation of polymerization. The temperature would then be maintained at whatever level is necessary to obtain the optimum speed and degree of polymerization. For example, the temperature could be raised to about 85° C. or 90° C. at the end of the first step and maintained at that temperature for the remainder of the treatment process.

The acid, monomer, fabric and heat may be combined in the first step of the treatment process in virtually any desired order, so long as all four of these elements are present prior to initiating polymerization for a sufficient time to allow uniform dispersal and intimate contact of the monomer with the fiber surfaces. For example, the order of combination in the first step may be any of the following: (1) addition of acid and monomer to water, addition of a delayed initiator (to be activated in the second step), and heating to the desired temperature; (2) addition of monomer and a delayed initiator to water, addition of acid and heating to the desired temperature; (3) addition of monomer to water, heating to desired temperature and addition of acid and delayed initiator; or (4) addition of acid monomer to water, addition of delayed initiator and heating to desired temperature. Other possible orders of carrying out the first step will be evident to those skilled in the art based on the present disclosure.

Such uniform dispersal and intimate contact may be assisted by various forms of agitation of flow of the aqueous treating solution around and between the fiber surfaces. For example, in the case of the treatment of fibers in the form of fabric piece goods, agitation may be accomplished by the paddles in a conventional paddle tub. Alternatively, for fibers in the form of fabrics which are processed in the form of rolls on a beam, the aqueous treating solution may be circulated around and through the beam by conventional pressure means.

The time necessary for attaining uniform dispersal and intimate contact will vary with the particular method of contacting the fibers with the aqueous solution. Although it is possible that the aqueous solution could be contacted with the fibers by spraying, padding, dipping or other means, it is most preferable to immerse the fibers in a bath formed by the aqueous solution. Using such immersion techniques, relatively short periods of time are necessary before polymerization may begin. For example, about 10 minutes is usually sufficient with adequate agitation or circulation of the aqueous solution.

After uniform dispersal and intimate contact has been achieved, polymerization of the monomer on the fibers may be commenced with the use of a suitable polymerization initiator such as peroxide or persulfate compounds which are known in the art. The particular initiator selected will depend upon the particular polymer fiber, the particular monomer used and the speed or other conditions of the polymerization desired. If desired, the initiator may be added during the first step so long as it is not activated until uniform dispersal and intimate contact of the monomer with the fiber surfaces are acheived. The initiation of polymerization may then be carried out, such as by raising the temperature, changing the pH or changing some other condition which will activate the initiator.

Finally, the polymerization is allowed to continue until there has been substantial graft polymerization of the monomer on the polymer fibers to modify the surface properties of the fibers. Generally, a rather low degree of polymerization is desireable, since excessive polymerization will result in large amounts of homopolymer in the fibers and in the process equipment, which must be cleaned and washed out after completion of the process. Therefore, it is preferable to avoid polymerization which significantly clouds the treating solution, and such small polymers as will remain in solution are preferred.

To this end, it is preferable to carry out the process of the present invention using very low concentrations of monomer, such as in the range of about 0.01 to about 1.0 weight percent of the total solution and preferably about 0.02 to 0.5 weight percent of the solution. Such low concentrations allow easy control of the polymerization reaction so that a relatively clear solution is maintained throughout the process, and the processing equipment and fibers treated may be easily cleaned and washed out.

Although applicant has not been able to accurately measure the exact amount of graft polymerization added onto the polymer fibers, it appears that optimum processing according to the present invention results in the permanent add-on of about 0.1 weight percent or less of graft polymer based upon the weight of the polymer fiber.

While the process of the present invention may be used at any of a number of stages during the usual processing of polymer fibers or fabrics or other structures made from such fibers, it has been found preferable to use the process before the dyeing of the fibers or before there is any treatment of the fibers which would result in encapsulation or coating of the fiber surface. Thus, it is usual practice to encapsulate or "lock on" the dye or other fiber treatment chemicals, and such coatings will often interfere with the addition of the monomer to the polymer fiber. To the extent that there would still be addition, this would be gradually washed off through many washings.

Therefore, it is preferable that the fibers be scoured (e.g. washed with detergent) and rinsed prior to carrying out the treatment process of the present invention in order to remove dirt and other chemicals which may be present on the fibers. The process may then be carried out before dyeing or even in the dye bath but before the after treatment to set the dye. However, it is preferable to drain the treating solution and rinse the fibers before dyeing, in order to remove acid and excess homopolymer, which may interfere with reaction of the dye with the dye sites on the surface of the polymer fibers.

Whereas many of the teachings of the prior art such as Aikawa and Tanner involved the treating of fibers in the absence of polymerization initiators to avoid homopolymerization, the present invention employs polymerization initiators. Polymerization initiators are generally of four basic types, namely, peroxides, persulfides, acids and ceric compounds.

Non-limiting examples of polymerization initiators that may possibly be utilized in this invention include inorganic peroxides, e.g., hydrogen peroxide, barium peroxide, magnesium peroxide, etc., and the various organic peroxy compounds illustrative examples of which are the dialkyl peroxides, e.g., diethyl peroxide, dipropyl peroxide, dilauryl peroxide, dioleyl peroxide, distearyl peroxide, di-(tert.-butyl peroxide and di-(tert.-amyl) peroxide, such peroxides often being designated as ethyl, propyl, lauryl, oleyl, stearyl, tert.-butyl and tert.-amyl peroxides; the alkyl hydrogen peroxides, e.g., tert.-butyl hydrogen peroxide (tert.-butyl hydroperoxide), tert.-amyl hydrogen peroxide (tert.-amyl hydroperoxide), etc.; symmetrical diacyl peroxides, for instance peroxides which commonly are known under such names as acetyl peroxide, propionyl peroxide, lauroyl peroxide, stearoyl peroxide, malonyl peroxide, succinyl peroxide, phthaloyl peroxide, benzoyl peroxide, etc.; fatty oil acid peroxides, e.g., coconut oil acid peroxides, etc.; unsymmetrical or mixed diacyl peroxides, e.g., acetyl benzoyl peroxide, propionyl benzoyl peroxide, etc.; terpene oxides, e.g., ascaridole, etc.; and salts of inorganic peracids, e.g., ammonium persulfate and potassium persulfate.

When fibers are treated according to this invention, the reaction may also be initiated by ceric ions, for example, in the form of ceric salts such as ceric nitrate, ceric sulfate, ceric ammonium nitrate, ceric ammonium sulfate, ceric ammonium pyrophosphate, ceric iodate, and the like.

Non-limiting examples of suitable acids for use in the present invention include hydrochloric, phosphoric, sulfuric, nitric, acetic, formic, oxalic, tartaric, monochloroacetic, dichloroacetic, trichloroacetic and similar acids. Formic and hydrochloric acid have been found to be particularly suitable in carrying out the present invention. It is possible that an acid can function as both a catalyst and initiator, e.g., formic acid.

Non-limiting examples of unsaturated types of monomers that may possibly be utilized in this invention include N,N'-methylene-bis-acrylamide ($CH_2(NHCOCH{:}CH_2)_2$), N,N'-(1,2 dihyroxyethylene)-bis-acrylamide, acrylamide, acrylic acid, 2-propyn-1-ol, crotonic acid, tetraethylene glycol, styrene, alpha-methyl styrene, 1,1-diphenyl ethylene, alpha-vinyl naphthalene, vinylpyridine, 2-chloro-2,3-butadiene, methacrylic acid, methacrylamide, N-methylolacrylamide, N-methyl-N-vinyl formamide, N-vinyl pyrrolidone, 3-, 4- or 5-methyl-N-vinyl pyrrolidone, vinyl oxyethylformamide, methyl acrylate, ethyl acrylate, octyl methyl methacrylate, vinylacrylate, acrylonitrile, methacrylonitrile, acrylyl chloride, vinyl methyl ketone, methallylalcohol, acrolein, methacrolein, vinyl acetate, p-vinyl phenyl acetate, methylmethacrylate, vinyl chloride, vinylidene chloride, p-chlorostyrene, 2,5-dichlorostyrene, 1,1,7-trihydro-perfluoroheptyl acrylate, methyl alphachloroacrylate, acrylyl cyanide, styrene sulfonic acid, salts and esters of styrene sulfonic acid and glycidyl methacrylate. The preferred monomers are N,N'-methylene-bisacrylamide (NBA) and N,N'(1,2 dihydroxyethylene)-bisacrylamide.

A monomer may function as an acid. NBA, for example, is slightly acidic in aqueous solution. It is also possible to use specially modified monomer which can provide special characteristics to the fibers, or fabrics made therefrom, such as crease softness, lubricity (e.g. by including silicon groups on the monomer), adhesion, optical brightness, anti-bacterial, anti-fungal or anti-mildew properties, etc.

In a preferred embodiment of this invention with the monomer utilized selected from the group consisting of NBA and N,N'(1,2 dihyroxyethylene)-bis-acrylamide, the polymerization step of the process is conducted for a period of time between about 0.5 minutes and about 2 hours, preferably between about 1.0 minute and about 30 minutes. The amount of initiator in the treating solution is between about $1\times10^{-4}$ weight percent and 5.0 weight percent.

The particular concentrations of the monomer, acid and the initiator in the treating solution will vary widely depending upon such factors as the nature of the particular monomer, acid and initiator, the time and temperature of the treatment, and the nature and form of the fiber being treated. While certain concentrations may be fairly essential for a particular monomer, acid and initiator under a given set of treatment conditions, applicant cannot give general ranges which would apply to all monomers, acids and initiators under all conditions, but those of ordinary skill in the art will be able to optimize the concentrations by routine experimentation on the basis of the present disclosure.

Attaining the desired degree of treatment according to this invention would depend on the strength of the initiator and the concentration of the monomer and acid. Thus, for example, a strong initiator, one that is inherently strong and/or having a high concentration of initiator, would require a lower monomer concentration. Conversely, a weak initiator, one that is inherently weak and/or having a low concentration of initiator, would require a higher monomer concentration. In the latter case, the treatment according to this invention can be controlled by draining the initiator containing solution from the fabric once the desired extent of polymerization has been achieved.

After polymerization begins, such polymerization being a function of the concentration and type of the acid, the unsatured monomer, fabric, initiator and the speed and type of the equipment being used, the fibers are allowed to remain in solution at the required temperature long enough to assure that uniform graft polymerization ("substantial polymerization") has occurred, such time usually not exceeding 30 minutes. The fibers can then be rinsed to neutralize the pH and remove excess homopolymers, if any.

The invention will now be described in greater detail by reference to the following specific, non-limiting examples:

EXAMPLES I

Athletic socks made of 75% acrylic (ORLON) yarns and 25% nylon filaments were treated in a paddle-type dye tub containing 150 liters of water. Fifty ml of 33% HCl and 50 ml of about 88% formic acid were added to water heated to 160° F. (71° C.), and 56 grains of NBA were then dissolved in the water. Less than one pound of acrylic athletic socks was immersed in the solution, and the temperature was rapidly raised to 185° F. (85° C.) and held there for 10 minutes. Twenty-five grans of potassium persulfate was added, and three minutes after the addition a milky precipitate appeared. Ten minutes after the addition of persulfate, the tub was drained and the socks were rinsed with fresh water.

EXAMPLE II

The process of Example I was repeated with less than a pound of single knit fabric made of textured DACRON polyester (150 denier, 34 filament).

Testing Of Samples I and II

Polyester and acrylic samples processed according to Examples I and II were put through fifty home launderings with household detergent. Each set of ten wash cycles consisted of seven normal cycles with 30 grams of "Fab" home laundry detergent in a 10 pound capacity "Kenmore" home washer set on warm water wash, followed by three normal cycles set on warm water with no detergent.

Vertical wicking of samples was tested after drying after each set of ten wash cycles as follows: Samples were cut at different times and vertical wicking was tested by cutting a strip of fabric, suspending one end in water, and measuring distance wicked above the surface. Polyester readings were made at two minutes, and acrylic readings were made at five minutes. Controls were untreated acrylic and polyester. The results are tabulated in Tables I and II below.

TABLE 1

| POLYESTER VERTICAL WICKING | | |
|---|---|---|
| WASHING CYCLES | CONTROL (cm) | TREATED (cm) |
| 0 | 0 | 7 |
| 10 | 0 | 4.5 |

TABLE 1-continued

| POLYESTER VERTICAL WICKING | | |
|---|---|---|
| WASHING CYCLES | CONTROL (cm) | TREATED (cm) |
| 20 | 0 | 4.2 |
| 30 | 0 | 4.5 |
| 40 | 0 | 5 |
| 50 | 0 | 5.5 |

TABLE II

| ACRYLIC VERTICAL WICKING | | |
|---|---|---|
| WASHING CYCLES | CONTROL (cm) | TREATED (cm) |
| 0 | 3.5 | 10.2 |
| 10 | 3.2 | 10.5 |
| 20 | 3.6 | 10.2 |
| 30 | 3.4 | 10.0 |
| 40 | 3.5 | 9.0 |
| 50 | 3.5 | 9.1 |

In addition to the above-demonstrated hygroscopic properties, the fabrics treated in Examples I and II had excellent hand and feel characteristics, improved dyeability, good antistatic properties and generally improved surface properties.

The present invention may be embodied in other specific forms without departing from the spirit or essential attributes thereof and, accordingly, reference should be made to the appended claims, rather than to the foregoing specification, as indicating the scope of the invention.

I claim:

1. A method of treating polymer fibers selected from the group consisting of polyester and arcylic polymers to improve the hygroscopic, dye receptive and other surface properties of the fibers, comprising the steps of:

(a) contacting the fibers in the absence of a polymerization initiator with an aqueous solution heated to a temperature between about 60°–100° C., containing at least one unsaturated monomer under acidic conditions, and agitating said solution for about 10 minutes to allow uniform disposal and intimate contact of the monomer with the fiber surfaces;

(b) thereafter initiating polymerization of the monomer on the fibers by means of a polymerization initiator for the monomer; and (c) continuing the polymerization of the monomer on the fiber until substantial polymerization has occurred to modify surface properties of the fibers.

2. A method according to claim 1 wherein the pH of the aqueous solution is established and maintained below about 7 by addition of acid in step (a).

3. The method of claim 2 wherein said acid is selected from the group consisting of formic, hydrochloric, phosphoric, sulfuric, nitric, acetic, oxalic, tartaric, monochloroacetic, dichloroacetic and trichloroacetic.

4. A method according to claim 1 wherein the pH of the aqueous solution is established and maintained below about 7 by using an acidic monomer.

5. A method according to claim 1 wherein the pH of the solution is maintained below about 7 and the temperature of the solution is maintained between about 60° C. and 100° C. during steps (b) and (c).

6. A method according to claim 1 wherein the polymerization is continued for a period not exceeding about 30 minutes.

7. A method according to claim 1 wherein said fibers are scoured and rinsed prior to step (a).

8. A method according to claim 1 wherein said fibers are rinsed and dyed after step (c).

9. A method according to claim 1 wherein the solution is heated in step (a) to a temperature of about 70° C. to about 90° C.

10. A method according to claim 1 wherein step (c) is continued for about 10 minutes followed by draining the solution and rinsing the fibers with fresh water.

11. A method according to claim 1 wherein the fibers are in the form of a knitted, woven or non-woven fabric.

12. A method according to claim 11 wherein said fabric comprises a mixture of acrylic yarn and nylon filaments.

13. A method according to claim 11 wherein said fabric comprises yarns which are a blend of polyester and cotton staple fibers.

14. A method according to claim 1 wherein the fibers are treated as follows:

(a) immersing said fibers in an aqueous solution at about 70° C. containing about 0.01 weight percent hydrochloric acid, about 0.03 weight percent formic acid and about 0.04 weight percent N, N'-methylene-bis-acrylamide, rapidly raising the temperature of the solution to about 85° C. and agitating the fibers in the solution for about 10 minutes;

(b) thereafter adding about 0.02 weight percent potasium persulfate to the solution to initiate polymerization; and (c) continuing the polymerization for about 10 minutes, followed by draining the solution from the fibers and rinsing the fibers in water, all weight percents being on the basis of percentage by weight of the total solution.

15. The method of claim 1 which further comprises rinsing said fibers or fibrous structures after substantial polymerization has occurred to neutralize the pH and remove any excess homopolymers.

16. The method of claim 1 wherein said initiator is selected from the group consisting of peroxides, persulfates, acids and ceric salt compounds.

17. The method of claim 1 wherein said monomer is selected from the group consisting of N,N'-methylene-bisacrylamide; N,N'-(1,2 dihydroxyethylene)-bis-acrylamide; salts of N,N'-methylene-bis-acrylamide; salts of N,N'-(1,2 dihydroxyethylene)-bis-acrylamide; acrylic acid, 2-propyn-1-ol; crotonic acid and.

18. The method of claim 1 wherein the amount of said monomer is between about 0.01 weight percent and about 1.0 weight percent based on the total weight of said solution.

19. The method of claim 1 wherein the amount of said monomer is between about 0.02 weight percent and about 0.5 weight percent based on the total weight of said solution.

20. The method of claim 1 wherein said polymerization has a duration of between about 0.5 minutes and about 2.0 hours.

21. The method of claim 1 wherein said polymerization has a duration of between about 1.0 minute and about 30 minutes.

22. The method of claim 1 wherein said solution is agitated during steps (a), (b) and (c).

23. The improved polymer fiber product produced by the method of claims 11, 12, 13, 14, 15.

* * * * *